US009070964B1

(12) United States Patent
Schuss et al.

(10) Patent No.: US 9,070,964 B1
(45) Date of Patent: Jun. 30, 2015

(54) METHODS AND APPARATUS FOR VOLUMETRIC COVERAGE WITH IMAGE BEAM SUPER-ELEMENTS

(75) Inventors: Jack J. Schuss, Newton, MA (US); Thomas V. Sikina, Acton, MA (US); Kaichiang Chang, Northborough, MA (US); Jeffrey C. Upton, Groton, MA (US)

(73) Assignee: Raytheon Company, Waltham, MA (US)

( * ) Notice: Subject to any disclaimer, the term of this patent is extended or adjusted under 35 U.S.C. 154(b) by 433 days.

(21) Appl. No.: 13/329,682

(22) Filed: Dec. 19, 2011

(51) Int. Cl.
*H01Q 3/00* (2006.01)

(52) U.S. Cl.
CPC ..... *H01Q 3/00* (2013.01)

(58) Field of Classification Search
CPC ..... H01Q 3/00
USPC ..... 342/359, 25 A–25 F
See application file for complete search history.

(56) References Cited

U.S. PATENT DOCUMENTS

| | | | | |
|---|---|---|---|---|
| 3,021,521 | A | 2/1962 | Hutchins | |
| 4,197,540 | A | 4/1980 | Riggs et al. | |
| 4,216,472 | A | 8/1980 | Albanese | |
| 4,970,519 | A | 11/1990 | Minnis et al. | |
| 5,646,625 | A | 7/1997 | Burrier | |
| 5,966,048 | A | 10/1999 | Thompson | |
| 6,078,289 | A * | 6/2000 | Manoogian et al. | 342/373 |
| 6,218,987 | B1 * | 4/2001 | Derneryd et al. | 342/373 |
| 6,252,542 | B1 | 6/2001 | Sikina et al. | |
| 6,279,399 | B1 * | 8/2001 | Holm | 73/626 |
| 6,496,158 | B1 | 12/2002 | Ksienski et al. | |
| 6,507,315 | B2 | 1/2003 | Purdy et al. | |
| 6,799,014 | B2 | 9/2004 | Rosen et al. | |
| 6,856,284 | B1 | 2/2005 | Cangiani | |
| 6,933,878 | B1 | 8/2005 | Molyneux-Berry | |
| 6,963,312 | B2 | 11/2005 | Schuneman et al. | |
| 7,180,457 | B2 | 2/2007 | Trott et al. | |
| 7,250,902 | B2 | 7/2007 | Manoogian et al. | |
| 7,477,921 | B2 | 1/2009 | Shatti | |
| 7,492,313 | B1 | 2/2009 | Ehret et al. | |
| 7,538,564 | B2 | 5/2009 | Ehrmann et al. | |
| 7,808,427 | B1 | 10/2010 | Sarcione et al. | |
| 8,279,118 | B2 * | 10/2012 | Snow | 342/372 |
| 2005/0001754 | A1 * | 1/2005 | Sparrow et al. | 342/13 |
| 2006/0208944 | A1 * | 9/2006 | Haskell | 342/368 |
| 2008/0204318 | A1 | 8/2008 | Thomas et al. | |
| 2008/0272959 | A1 | 11/2008 | Meharry et al. | |
| 2011/0187583 | A1 | 8/2011 | Nouvel et al. | |
| 2012/0319900 | A1 * | 12/2012 | Johansson et al. | 342/368 |

OTHER PUBLICATIONS

Notice of Allowance dated Dec. 7, 2011 from U.S. Appl.No. 12/635,893.
U.S. Appl. No. 12/466,066, filed May 14, 2009.
U.S. Appl. No. 12/635,916, filed Dec. 11, 2009 .
(Continued)

*Primary Examiner* — Harry Liu
(74) *Attorney, Agent, or Firm* — Daly, Crowley, Mofford & Durkee, LLP

(57) ABSTRACT

Methods and apparatus for a super-element assembly for a phased array radar aperture, the super-element assembly having a first port and a second port to receive a first signal at the first port to generate a main beam, and receive a second signal at the second port to generate an image beam for generating scan volume coverage using the main and image beams.

22 Claims, 14 Drawing Sheets

(56) References Cited

OTHER PUBLICATIONS

U.S. Appl. No. 12/730,533, filed Mar. 24, 2010.
U.S. Appl. No. 12/635,893, filed Dec. 11, 2009.
Notice of Allowance and Issue Fee Due dated Dec. 7, 2011 for U.S. Appl. No. 12/635,893, 5 pages.
U.S. Appl. No. 13/550,890 Notice of Allowance dated Sep. 2, 2014, 16 pages.
Office Action dated Jul. 31, 2014 for U.S. Appl. No. 13/331,334, filed Dec. 20, 2011, 20 pages.
U.S. Appl. No. 13/662,641, Office Action dated Oct. 14, 2014, 14 pages.
U.S. Appl. No. 13/662,641 Amendment filed Feb. 17, 2015, 6 pages.
U.S. Appl. No. 13/331,334 Notice of Allowance dated Jan. 13, 2015, 14 pages.
Response filed Nov. 25, 2014; to Office Action dated Jul. 31, 2014; for U.S. Appl. No. 13/331,334; 9 pages.

* cited by examiner

Layer Stack Up Dimensions

| Layer | Material | Thick (in.) | $\varepsilon_r$ | $\delta_d$ |
|---|---|---|---|---|
| 1 | Foam (Roh 71) | 0.317 | 1.08 | 0.0003 |
| 2 | Adhesive | 0.005 | 2.2 | 0.002 |
| 3 | Taconic RF-43 | 0.01 | 4.3 | 0.0033 |
| 4 | Adhesive | 0.005 | 2.2 | 0.002 |
| 5 | Foam (Roh 71) | 0.26 | 1.08 | 0.0003 |
| 6 | Adhesive | 0.005 | 2.2 | 0.002 |
| 7 | Taconic RF-43 | 4.3 | 4.3 | 0.0033 |

410 — Lower Patch Width: 0.857
412 — Upper Patch Width: 0.3
Patch Thickness 0.0007

Lower Patch Strip on Bottom of Layer 3
Upper Patch Strip on Top of Layer 7

METHODS AND APPARATUS FOR VOLUMETRIC COVERAGE WITH IMAGE BEAM SUPER-ELEMENTS

BACKGROUND

As is known in the art, phased array radars have a number of advantages over other types of radar systems while having certain potential disadvantages. One potential limitation to the design and operation of phased array antennas used in radars and communication systems is the limited scan volume coverage if super-elements are used; super-elements may be employed in order to reduce costs, at the expense of smaller scan volumes. Scan volumes are limited since a super-element assembly comprises a number of individual radiator elements coupled to a common transmission line, and the resulting larger area super-element "subarray" has a reduced scan volume that corresponds to the beamwidth of the "subarray."

SUMMARY

The present invention provides methods and apparatus for dual port super-element assemblies having independent image and main beam ports to provide wide scan coverage in phased array radar systems. While exemplary embodiments of the invention are shown and described in conjunction with particular applications and configurations, it is understood that embodiments of the invention are applicable to radars in general in which it is desirable to increase scan volume.

In one aspect of the invention, a method comprises employing a super-element assembly for a phased array radar aperture, the super-element assembly having a first port and a second port, employing a first signal at the first port to generate a main beam, and employing a second signal at the second port to generate an image beam.

The method can further include one or more of the following features: the first and second signals have about the same magnitude, the main beam and the image beam are excited independently, the first and second ports are disposed at opposing ends of the super-element assembly, a position of the first beam is angle theta in relation to a surface normal to the aperture and a position of the second beam is minus theta, tilting the aperture about an axis to reposition the first and second beams, providing a second face for the aperture to produce a further coverage region, obtaining multiple look angles for a target using the first and second faces of the aperture, tilting the second face about an axis, and/or providing a third face for the aperture In another aspect of the invention, a system comprises a super-element assembly for a phased array radar aperture, comprising: a first port to receive a first signal to generate a main beam, and a second port to receive a second signal to generate an image beam for generating scan volume coverage from the main beam and the image beam.

The system can further include one or more of the following features: the first and second ports are located orthogonally to generate feed waveguide waves having opposing propagation vectors, when the super-element assembly is excited from the first port a main beam scan volume is produced with frequency scanning along a v coordinate and phase scanning along a u coordinate, when the super-element is excited from the second port an image beam scan volume is produced with independent u coordinate scanning for each beam and frequency dependent v coordinate scanning, the super-element forms a part of an array tilted about a single axis with respect to a horizontal axis, and/or the super-element forms a part of an array tilted about first and second axes.

In a further aspect of the invention, a radar system comprises an aperture including first, second and third faces, the first face comprising: a super-element assembly for a phased array radar aperture, comprising: a first port to receive a first signal to generate a main beam, and a second port to receive a second signal to generate an image beam for generating scan volume coverage from the main beam and the image beam. In one embodiment, the first face is tilted to obtain multiple looks at a target. In one embodiment, the first and second ports are located at opposite ends of the super-element to increase the scan volume of the main beam by also generating an image beam.

BRIEF DESCRIPTION OF THE DRAWINGS

The foregoing features of this invention, as well as the invention itself, may be more fully understood from the following description of the drawings in which.

DETAILED DESCRIPTION

Before describing exemplary embodiments of the inventive super-element assembly, some information is provided.

As is known in the art, a super-element assembly comprises a number of individual radiator elements coupled to a common transmission line. This can be realized in a number of topologies, including configurations of waveguides with slot radiators, configurations of radiators fed by stripline feeds, and configurations of oversized (>λ/2) waveguide radiators. Conventional super-element assemblies have one port to receive a signal and another port to terminate the signal.

Figure 1:
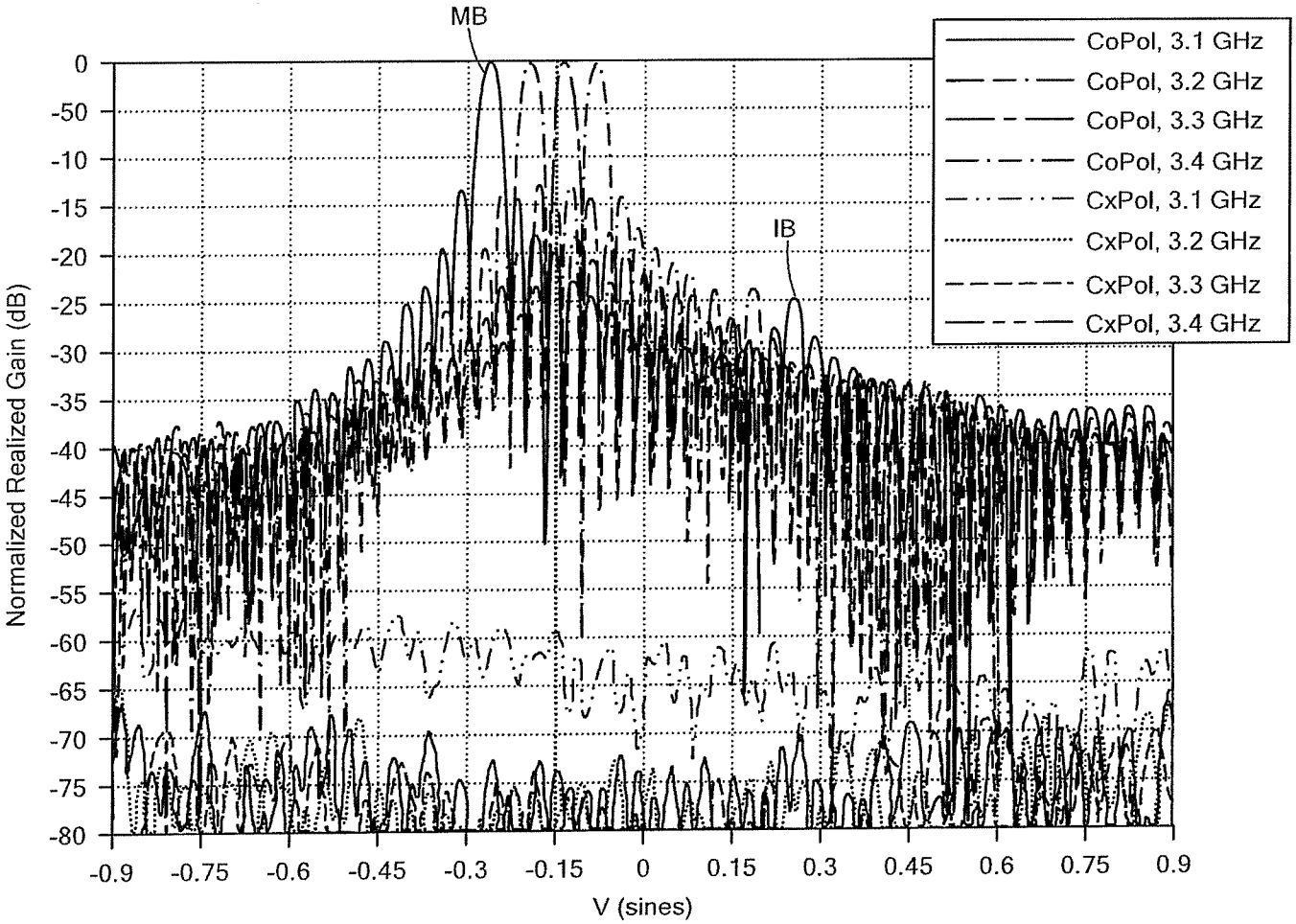
PRIOR ART FIG. 1
FIG. 1 is a graphical representation of a simulated realized gain for an phased array radar having a super-element assembly with an input port and a termination port.

FIG. 1 shows a simulated graphical representation of normalized gain versus angle in V (sines) for a super-element assembly having a signal port and a termination port. For a given signal, a main beam MB is generated along with an image beam IB. The image beam IB occurs at the image location about the aperture surface normal (0 degrees). It should be noted that the image beam is not directly excited. The image beam is generated by reflection coefficients at the termination port (about −22 dB) and is reduced by the reverse taper of the feed (about −3 dB). As shown, the image beam IB is typically −25 db or lower in relation to the main beam MB.

In one aspect of the invention, a super-element assembly comprises a first port to receive a first signal and a second port to receive a second signal so that both forward and reverse beams are excited independently. With this arrangement, volumetric coverage of the array can be significantly increased, as discussed more fully below.

Figure 2:
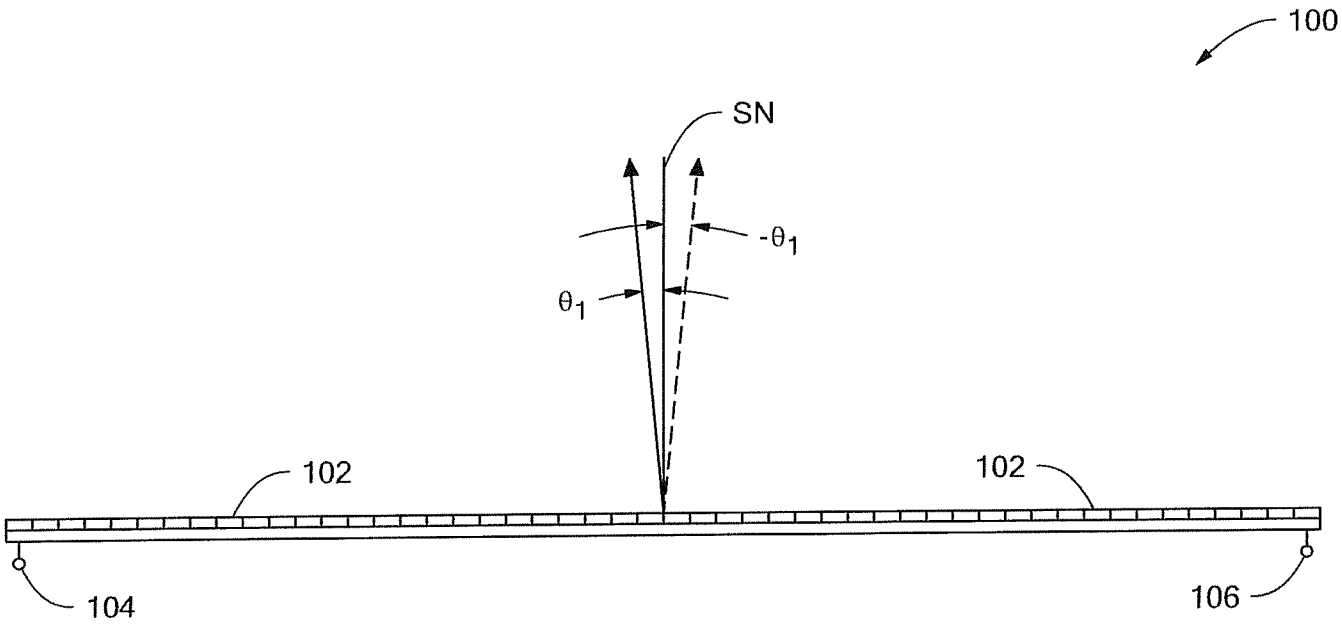
FIG. 2 is a schematic representation of a super-element assembly with first and second signal ports in accordance with exemplary embodiments of the invention.

FIG. 2 shows a portion of an exemplary aperture 100 having super-element assemblies 102 having a first port 104 to receive a first signal and a second port 106 to receive a second signal. The super-element assembly 102 includes radiator elements along a length of the assembly. In one embodiment, the super-element assembly has an orthogonal port system. That is, the first and second ports 104, 106 are located to generate feed waveguide waves having opposing propagation vectors. An excitation on one port causes a phase progression opposite to that of the orthogonal port. The opposite phase progression causes isolated main and image beams. As shown, the first port beam (main beam) position is $\theta_1$ and the second port beam (image beam) position is $-\theta_1$ with respect to a surface normal SN.

Figure 2A:
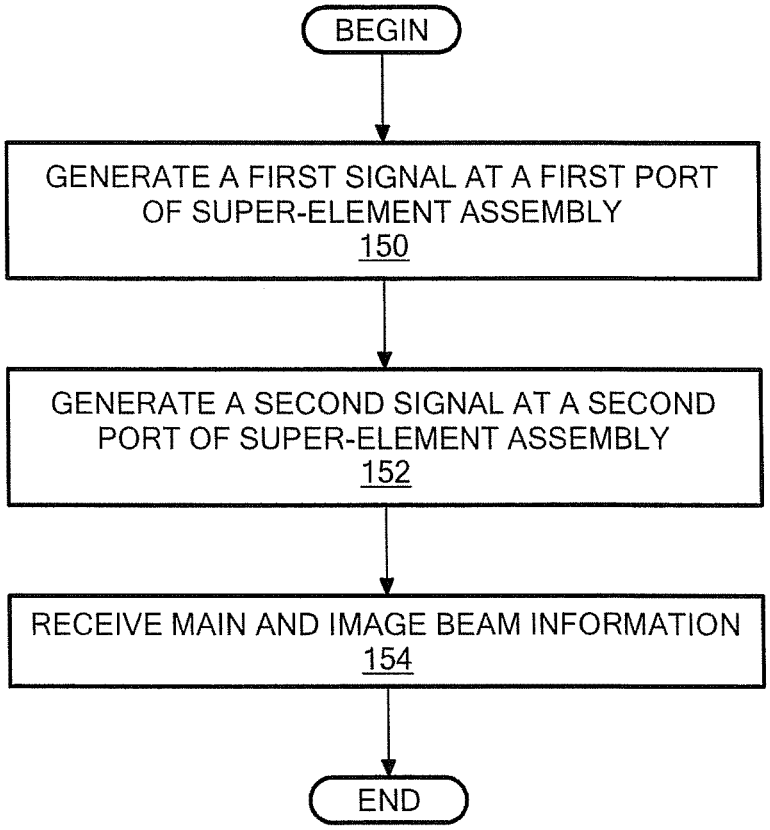
FIG. 2A is a flow diagram showing an exemplary sequence of steps for generating main and image beams for a super-element assembly in accordance with exemplary embodiments of the invention.

As shown in FIG. 2A, an exemplary sequence of steps includes providing a first signal at a first port of a super-element assembly at step 150 and providing a second signal at a second port at step 152. The port excitations generate main and image beams to increase the scan volume coverage of the array. In step 154, main and image beam information is received.

Figure 3:
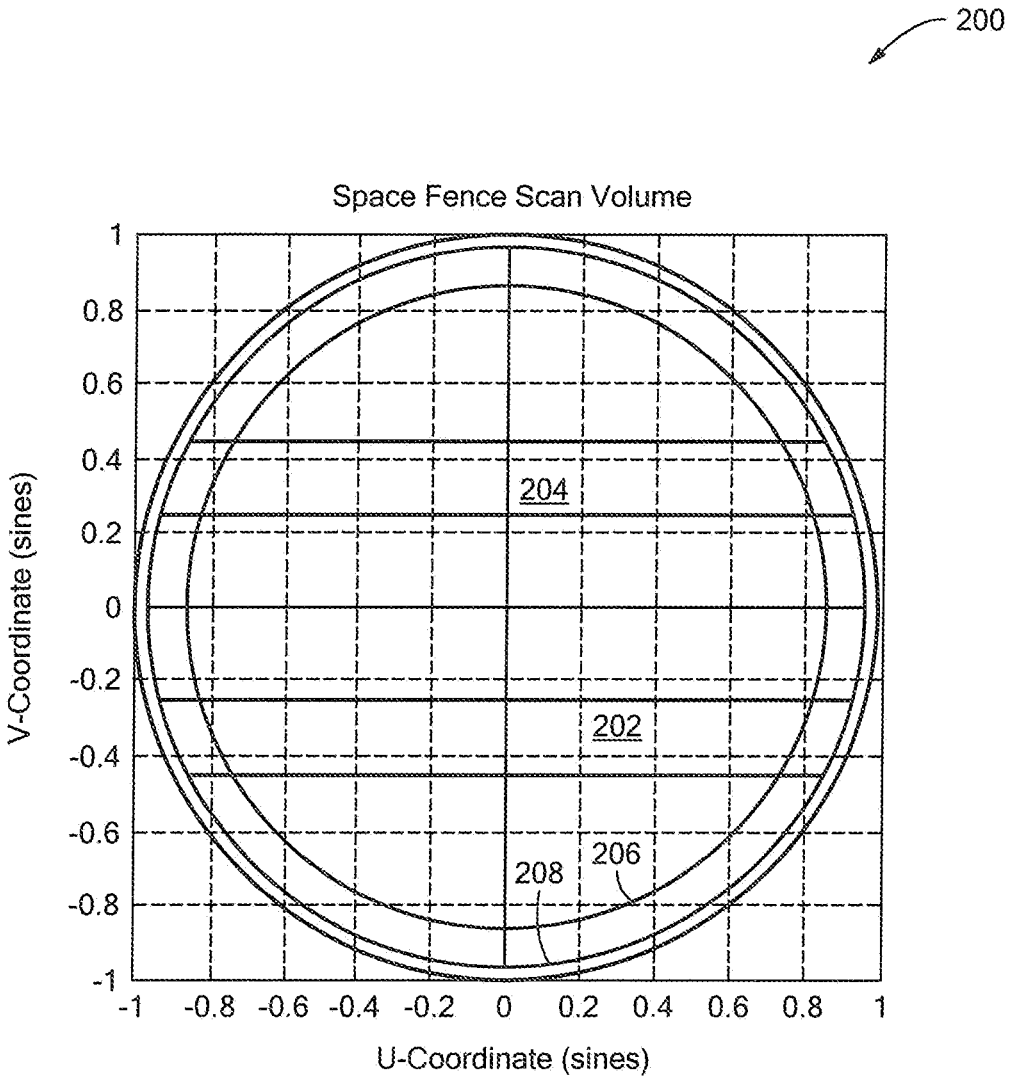
FIG. 3 is a representation of a scan volume showing an image beam and main beam.

FIG. 3 shows an exemplary radar system scan volume 200 in u and v coordinates (15 to 25 degree frequency scan). u corresponds to the cosine of the angle between the scanned beam and the x axis of the array, and v corresponds to the cosine of the angle between the scanned beam and the y axis of the array. In this case the y axis of the array is also the axis of the super-element. When the super-element assembly is excited from the first or feed port, a main beam scan volume 202 is produced with frequency scanning along the v coordinate and phase scanning along the u coordinate. When the super-element is excited from the second or load port, an image beam scan volume 204 is produced with independent u coordinate scanning for each beam and frequency dependent v coordinate scanning. In this latter case, for a given frequency the arrays scans to the negative of the v scan direction resulting from exciting the first or feed port. It is understood that the relative gain, efficiency, and polarization of each beam set is determined by the characteristics of a particular super-element assembly. Scan volume boundaries are shown for a 60 degree scan 206 and a 76 degree scan 208. As can be seen, exciting both ports radiates beams at both +/−v, which greatly increases the scan volume of the array in the v direction.

Figure 4:
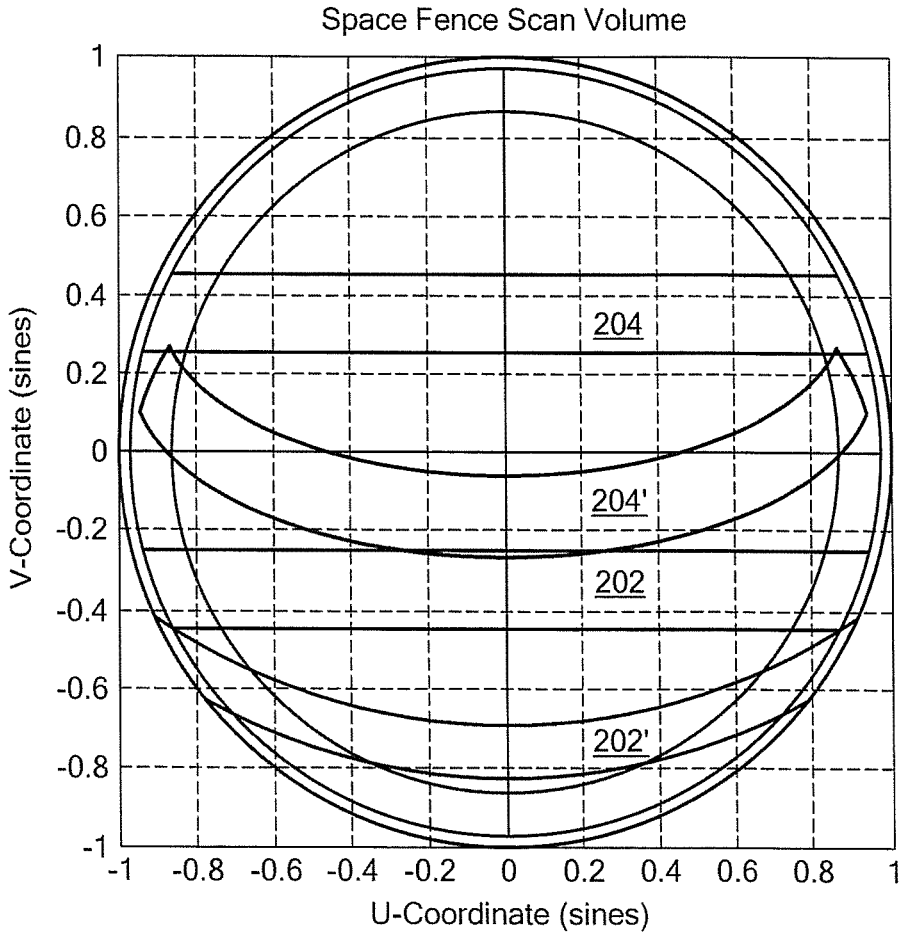
FIG. 4 is a representation of a scan volume showing an image beam and main beam repositioned with a tilt of the array.

FIG. 4 shows a scan volume for an array tilt of 30 degrees from horizontal about a single axis, here the x-axis, for a 15 to 25 degree frequency scan. In this case, the super-element axis is tilted 30° from horizontal, so that this axis now has a vertical component. The main and image beam positions are repositioned by rotating the array about the x-axis to provide the repositioned main and image beams 202', 204'. It is understood that we may use multiple array faces to produce multiple coverage regions that can be optimized for coverage volume or minimal scan loss.

Figure 5A:
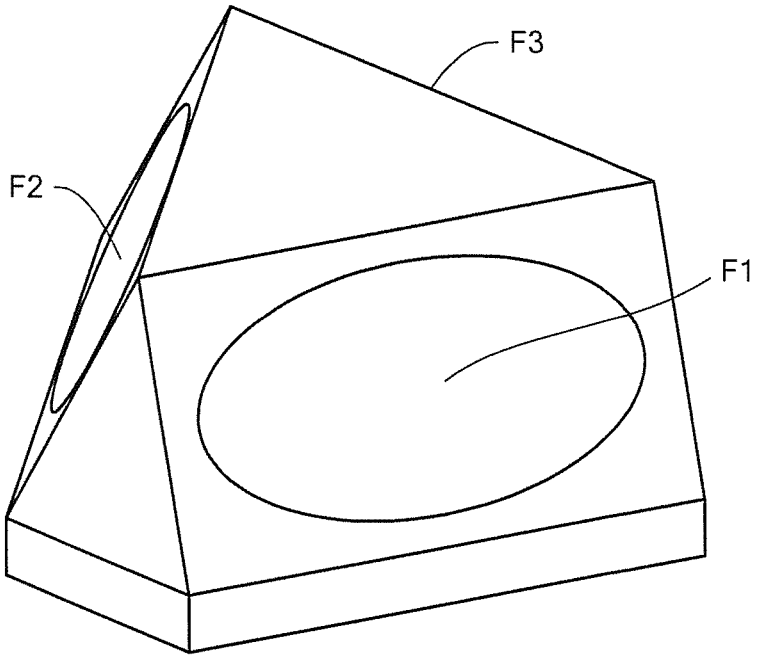
FIG. 5A is a schematic representation of a three-face tilted aperture.

FIG. 5A shows an exemplary aperture having three faces F1, F2, F3. The multiple apertures can be optimized for coverage or minimal scan loss. Rotation about the y-axis (frequency scan) results in less scan loss in the orthogonal plane. The multiple angles provide multiple look angles at the target for increased radar target accuracy.

Figure 5B:
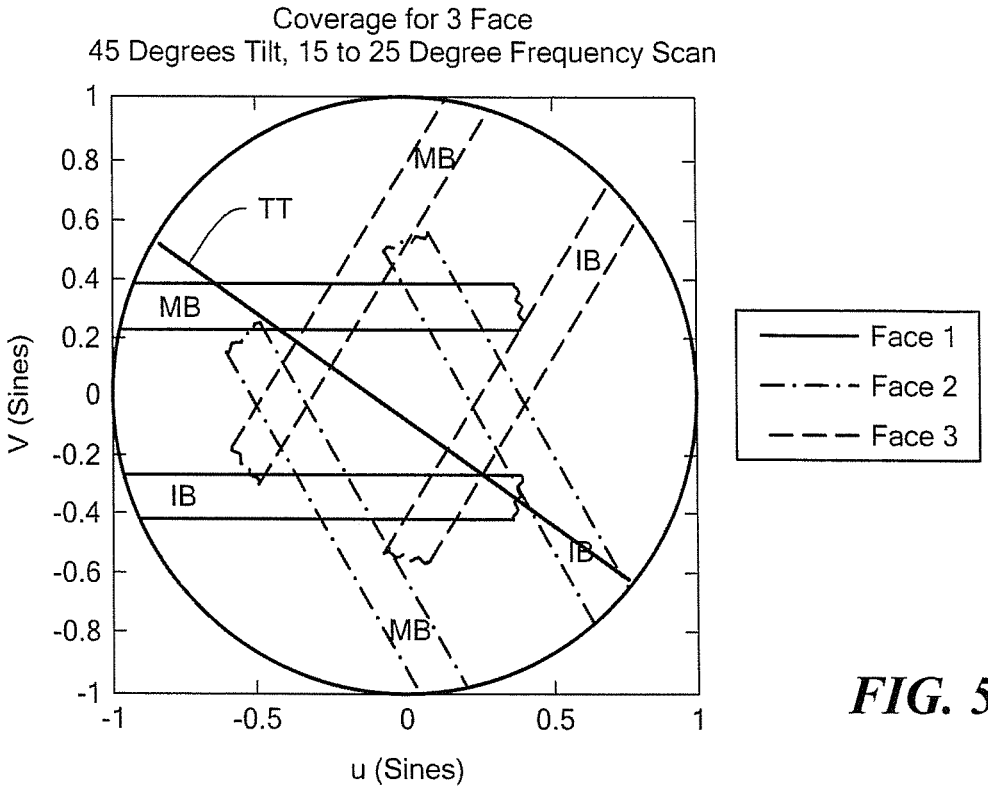
FIG. 5B is a representation of a further scan volume showing a target track for a multi-face aperture having image beam and main beams; here each face scans its beams in v from 15 degrees to 25 degrees off normal.
Figure 5C:
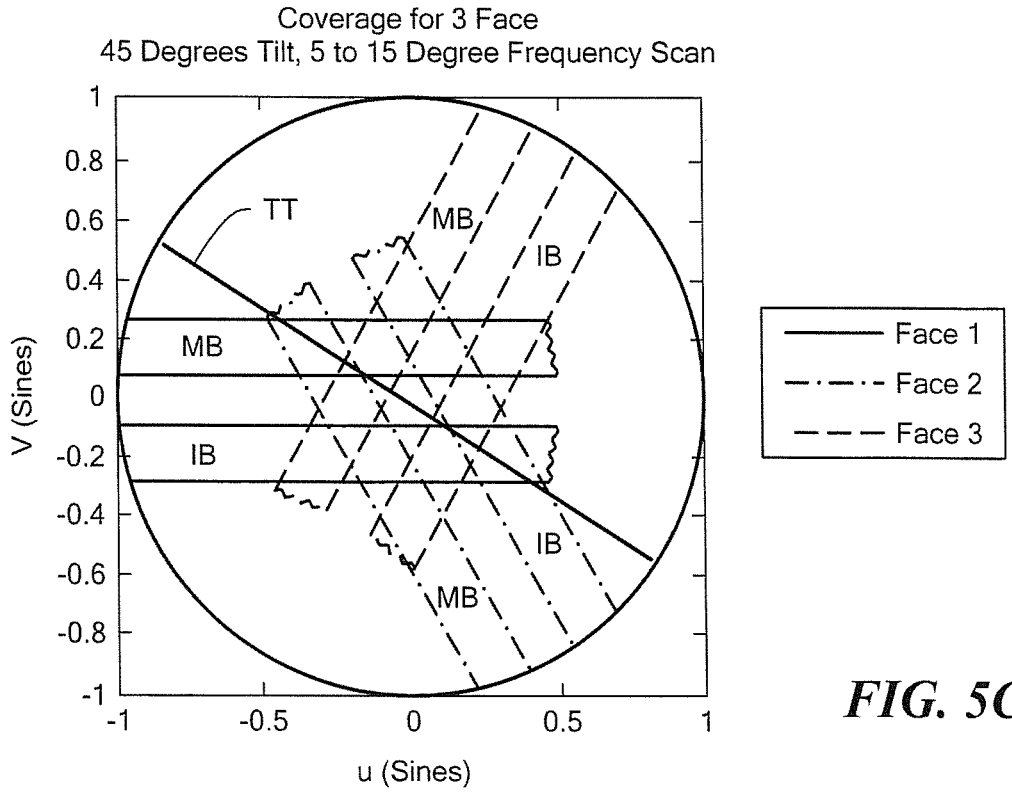
FIG. 5C is a representation of a scan volume showing a target track for a multi-face aperture having image beam and main beams; here each face scans its beams in V from 5 to 15 degrees off normal.

FIG. 5C shows a scan volume including a main beam MB and an image beam IB for a three-face aperture with a 45 degree y-axis tilt of the array for a 5 to 15 degree frequency scan; in this case the arrays are tilted 45° with respect to horizontal, but with the super-element axes remaining horizontal. FIG. 5B shows a scan volume for a similar three-face aperture with a 45 degree tilt of the array but with a 15 to 25 degree frequency scan.

FIG. 5C shows three look angles for a target, one look angle for each of the three faces F1, F2, F3 (FIG. 5A) of the aperture. As can be seen on the right side of the volume scan, for the first face the beams end at about 0.5 on the u axis due to the 45 degree tilt of the array and the maximum scan angle, e.g., 60 degrees. A target track TT is shown. The different looks at the target from the three aperture faces can be seen with the main and image beams MB, IB thereby increasing volumetric coverage. FIG. 5B is similar to FIG. 5C but with a 5 to 15 degree frequency scan.

Figure 6:
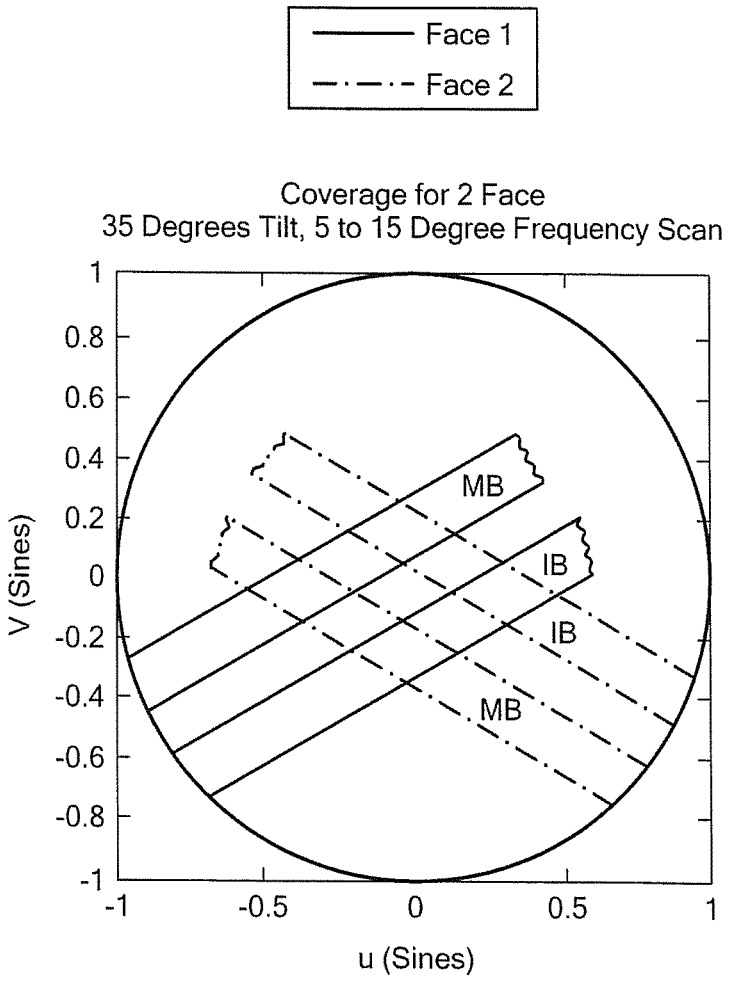
FIG. 6 is a representation of a scan volume for a tilted two-faced aperture.

FIG. 6 shows a scan volume for a two-face aperture with a 35 degree tilt with a 5 to 15 degree frequency scan. As can be seen, the main and image beams increase scan volume.

By providing first and second ports at opposing ends of the super-element assembly, the main beam and the image beam can be used to increase the scan volume. By tilting one or more aperture faces, a radar system can get multiple looks at a target to increase target track accuracy.

Figure 7:
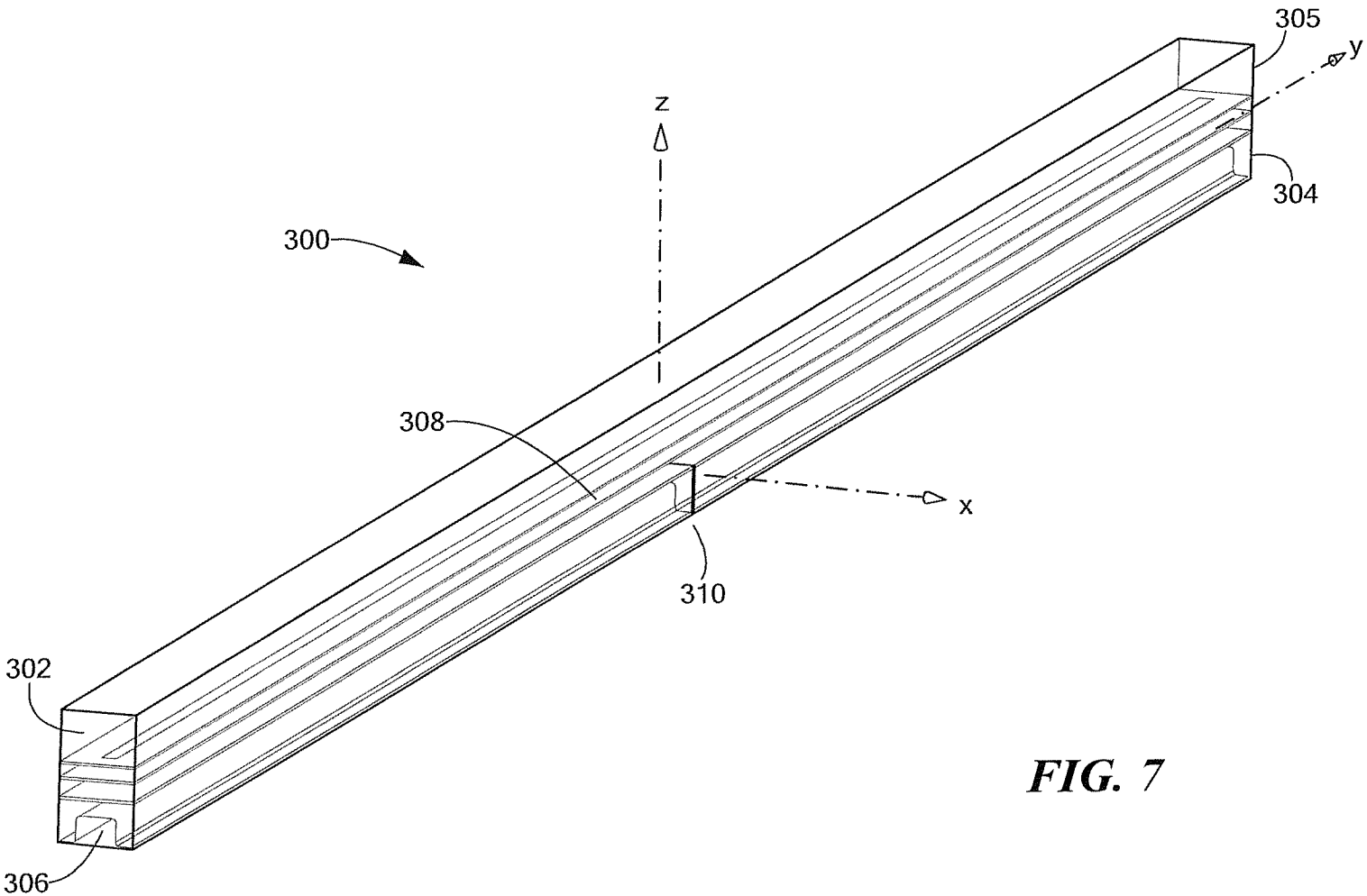
FIG. 7 is a pictorial representation of a super-element assembly having first and second signal input ports in accordance with exemplary embodiments of the invention.
Figure 8:
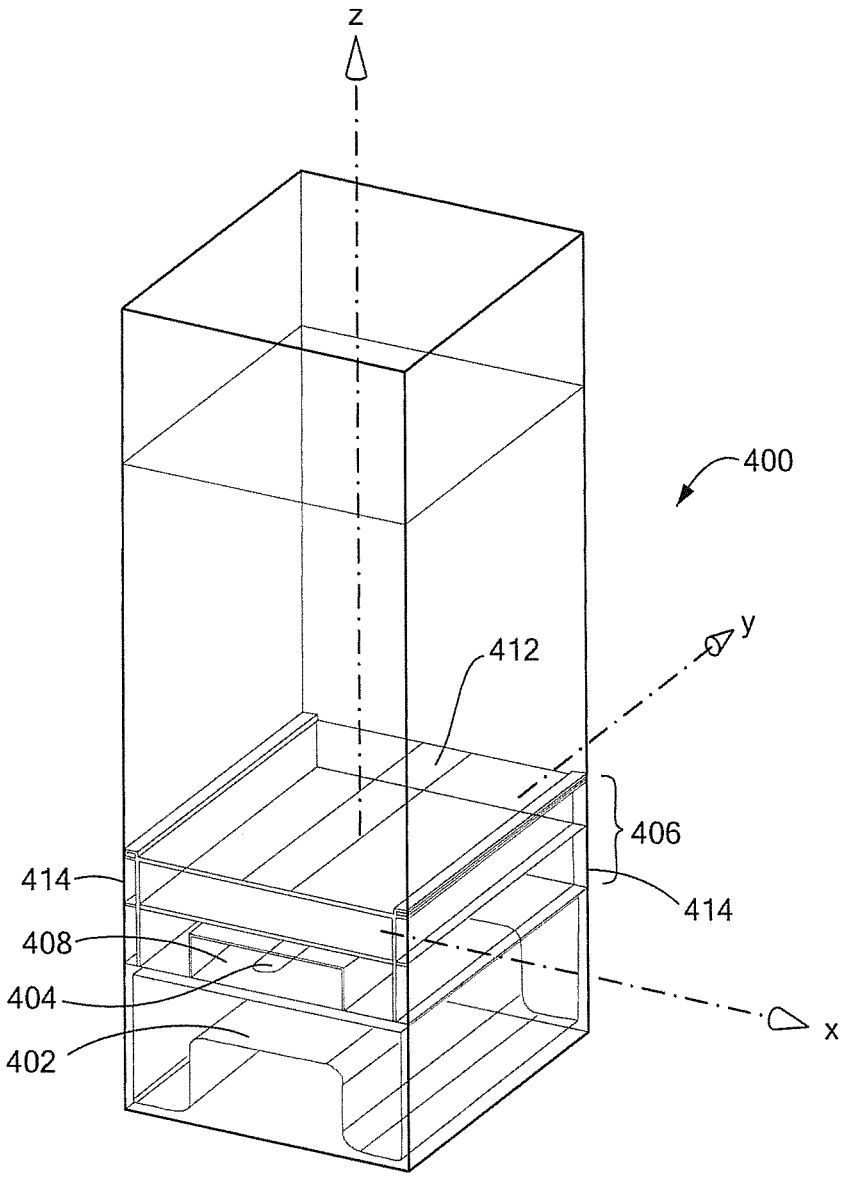
FIG. 8 is a depiction in model form of a unit cell of a super-element assembly.

It is understood that a variety of super-element assembly configurations can be used to provide main and image beam scan coverage. FIG. 7 shows an exemplary super-element radiator 300 and FIG. 8 shows a unit cell 400 in the super-element. The super-element 300 includes a first port 302 to receive a first signal and a second port 304 to receive a second signal for generating the main and image beams, as describe above. Simulated radiation boundaries 305 are disposed in the xz plane above a ridged waveguide 306 that extends along an axis of the super-element. Simulated master/slave walls 308 are located on the sides in yz plane above the waveguide 306. Note that a split 310 in the waveguide is shown for modeling purposes to help the meshing process.

Figure 9A:
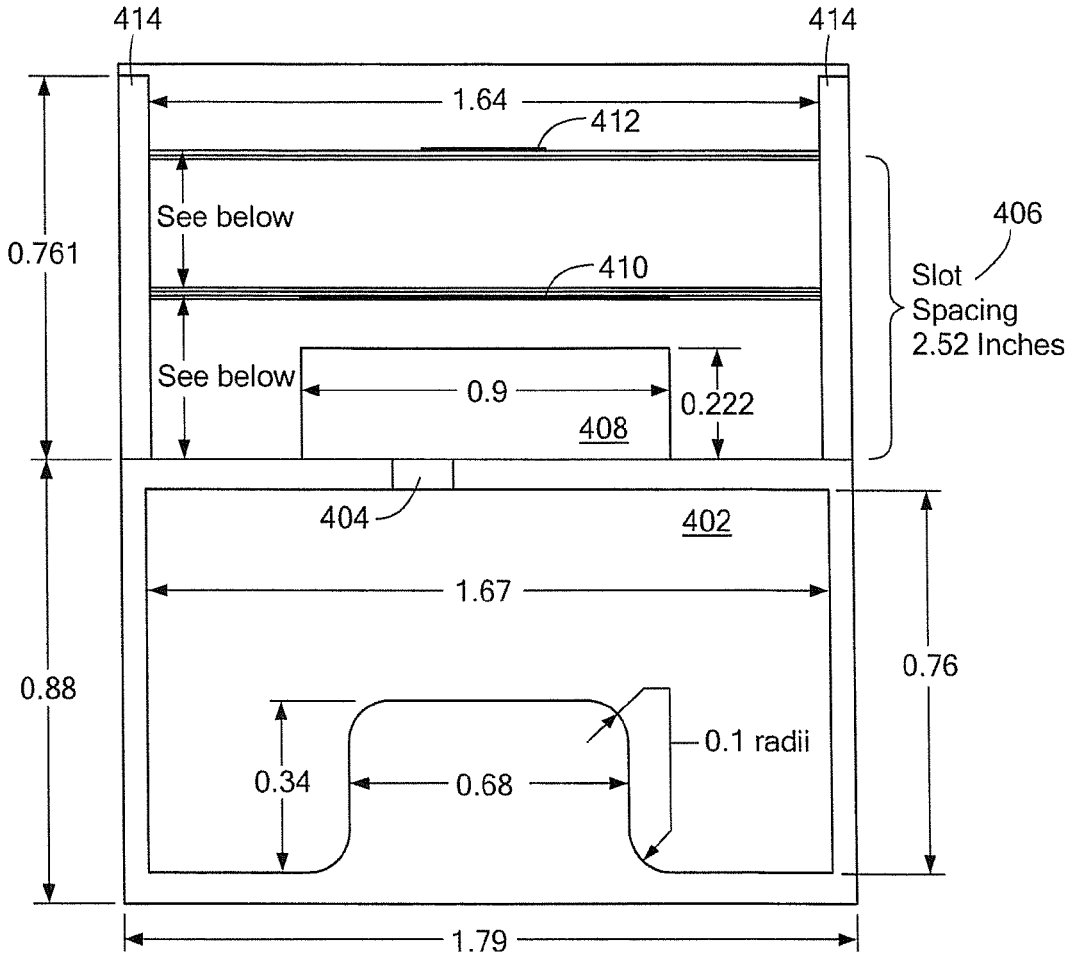
FIG. 9A is a cross-sectional view of a super-element assembly and FIG. 9B is a top view of a portion of a super-element assembly.
Figure 9B:
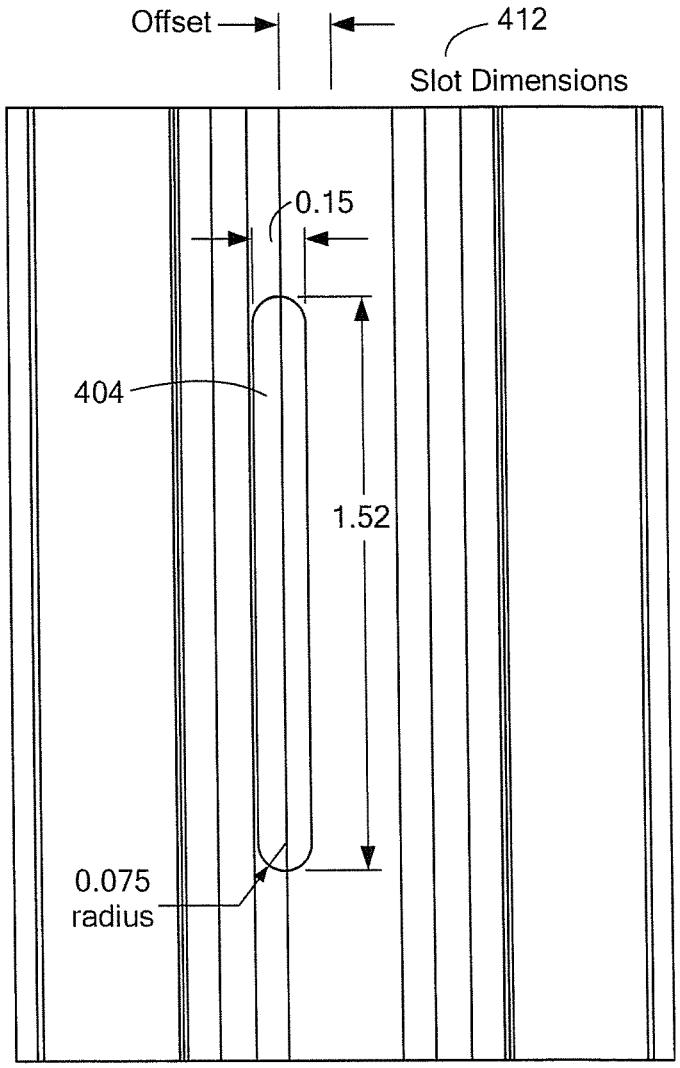
Figure 10:
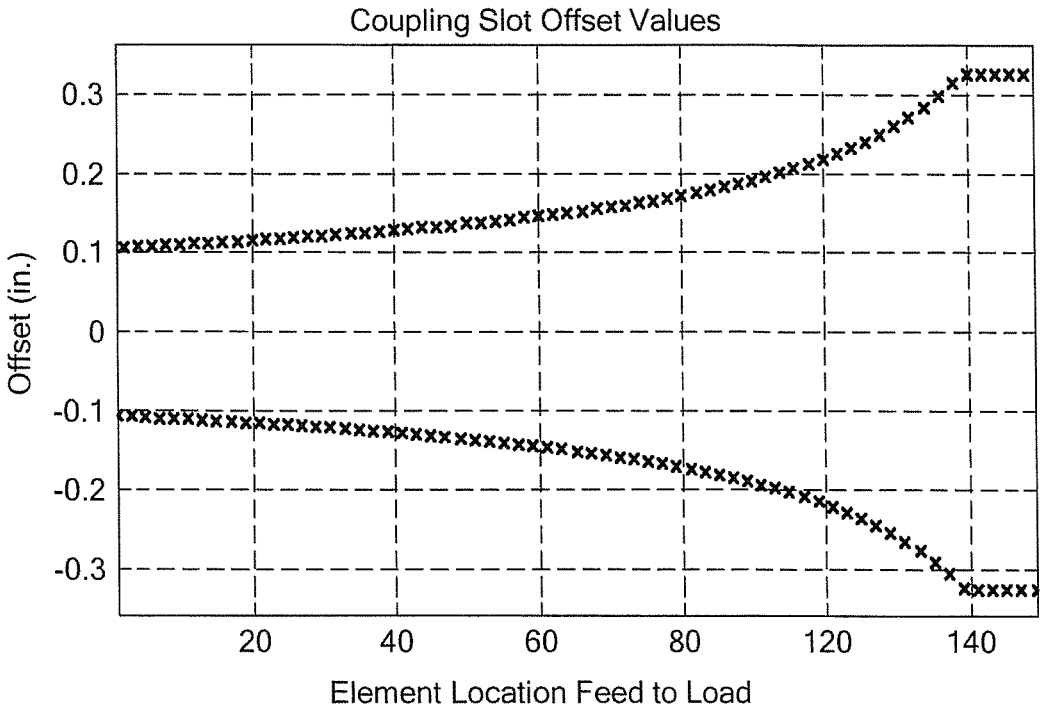
FIG. 10 is a graphical depiction of coupling offset value versus the element location along the super-element assembly.

FIG. 9A shows some further detail for a unit cell 400 of the radiator. The unit cell includes a single ridge waveguide 402, which is well known in the art. With a feed port at one end of the super-element and a termination at the other end, the super-element acts as a transmission line distributing electromagnetic power to each of the unit cells. The upper conductive wall of the waveguide is interrupted with a slot coupler 404. A dielectric assembly 406 is disposed over the waveguide 402. In an exemplary embodiment, the dielectric assembly includes a channel 408 and a layer stack shown above, which shows exemplary dimensions for the unit cell 400. The dielectric assembly includes first and second conductive strips or patches 410, 412 located at first and second heights above the coupling slot 404. The resonant conductive strips 410, 412 are suspended with low loss foam dielectric materials in a single sub-assembly. In an exemplary embodiment, the strips 410, 412 are continuous over the full length of the super-element. Conductive walls 414 enclose the dielectric and strip subassembly, also running the full length of the super-element. The conductive walls 414 form a long slot radiator, with an opening extending the full length of the super-element. As shown in FIG. 9B, in one embodiment, the coupler 404 is approximately 1.52 inches long, 0.15 inches wide, with semi-circular ends, and is cut out of the full height of the upper waveguide wall. FIG. 10 shows exemplary coupling slot offset values.

Figure 11:
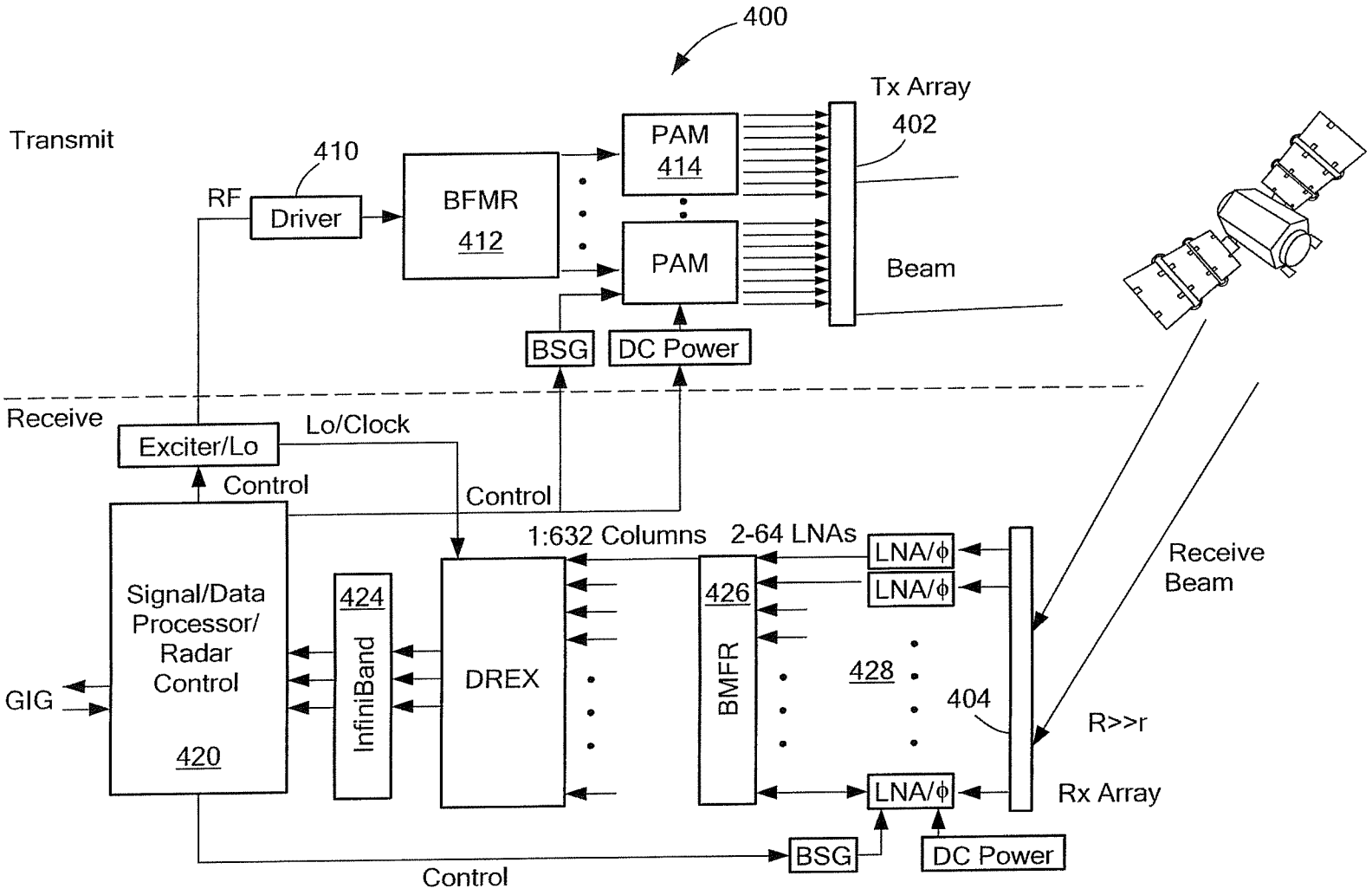
FIG. 11 shows an exemplary phased array radar system having super-element assemblies in accordance with exemplary embodiments of the invention.

It is understood that an exemplary super-element assembly can form a part of any practical phased array radar system. FIG. 11 shows an exemplary phased array radar system 400 having super-element radiators in accordance with exemplary embodiments of the present invention. In one embodiment, the radar system is optimized for tracking satellite targets. The phased array radar 400 has separate transmit and receive arrays 402, 404 with a remote target shown as a satellite. The system 400 includes on the transmit side a driver 410 coupled to a digital beamformer 412 feeding a PAM (Power Amplifier Module) 414, which energizes the transmit array 402. The receive side includes a signal data processor control module 420 coupled to a digital receive system 422 via a universal I/O device 424, such as InfiniBand. The receive beamformer 426 receives input from the low noise amplifiers 428, which are coupled to the receive array 404. The system 400 includes receive and/or transmit arrays having an exemplary super-element radiator in accordance with exemplary embodiments of the invention.

In an exemplary embodiment, the transmit aperture 402 and separate receive aperture 404 are sized to enable the radar system to track targets from 100 km to 42,000 km in altitude. In one particular embodiment, the system includes a transmit aperture of about 200 m by 14 m and a receive aperture of about 215 m by 27 m, both of which can be elliptical.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A method, comprising:

employing a super-element assembly for a phased array radar aperture, the super-element assembly having a first port and a second port and a longitudinal axis, wherein the first and second ports are located at opposing ends of the super-element assembly;

employing a first signal at the first port to generate a main beam at a first angle plus theta (+θ); and employing a second signal at the second port to generate an image beam at a second angle minus theta (−θ), wherein the first and second angles are oriented with respect to a surface normal of the super-element assembly longitudinal axis.

2. The method according to claim 1, wherein the first and second signals have about the same magnitude.

3. The method according to claim 1, wherein the main beam and the image beam are excited independently.

4. The method according to claim 1, wherein the first and second ports are disposed at opposing ends of the super-element assembly.

5. The method according to claim 1, further including tilting the aperture about an axis to reposition the first and second beams.

6. The method according to claim 1, further including providing a second face for the aperture to produce a further coverage region.

7. The method according to claim 6, further including obtaining multiple look angles for a target using the first and second faces of the aperture.

8. The method according to claim 6, further including tilting the second face about an axis.

9. The method according to claim 6, further including providing a third face for the aperture.

10. A system, comprising:

a super-element assembly for a phased array radar aperture, comprising:

a first port to receive a first signal to generate a main beam at angle theta; and a second port to receive a second signal to generate at minus theta an image beam for generating scan volume coverage from the main beam and the image beam wherein the first and second ports are located at opposing ends of the super-element assembly, and wherein theta is oriented with respect to a surface normal and a longitudinal axis of the super-element assembly.

11. The system according to claim 10, wherein the first and second ports are located orthogonally to generate feed waveguide waves having opposing propagation vectors.

12. The system according to claim 10, wherein when the super-element assembly is excited from the first port a main beam scan volume is produced with frequency scanning along a v coordinate and phase scanning along a u coordinate.

13. The system according to claim 12, wherein when the super-element is excited from the second port an image beam scan volume is produced with independent u coordinate scanning for each beam and frequency dependent v coordinate scanning.

14. The system according to claim 10, wherein the super-element forms a part of an array tilted about a single axis with respect to a horizontal axis.

15. The system according to claim 10, wherein the super-element forms a part of an array tilted about first and second axes.

16. A radar system, comprising:

an aperture including first, second and third faces;

the first face comprising:

a super-element assembly for a phased array radar aperture, comprising:

a first port to receive a first signal to generate a main beam at angle theta; and a second port to receive a second signal to generate at angle minus theta an image beam for generating scan volume coverage from the main beam and the image beam, wherein theta is oriented with respect to a surface normal of the super-element assembly.

17. The system according to claim 16, wherein the first face is tilted to obtain multiple looks at a target.

18. The system according to claim 16, wherein the first and second ports are located at opposite ends of the super-element to increase the scan volume coverage of the main beam the image beam.

19. The method according to claim 1, wherein the main beam the image beam are generated without a Butler matrix.

20. A method comprising:

employing a set of substantially identical super-element assemblies for a phased array radar aperture, each of the super-element assemblies having a first port and a second port;

employing respective first signals at the respective first ports of the super-element assemblies to generate a main beam; and employing respective second signals at the respective second ports of the super-element assemblies to generate an image beam.

21. The method according to claim 20, wherein the first and second beams frequency scan, and the first and second beams phase scan in a u direction by phasing multiple ones of side-by-side super-elements in the plurality of super-elements.

22. The method according to claim 20, wherein the main beam is configured to radiate at +v and the image beam is configured to radiate at −v, where v corresponds to a cosine of an angle between a scanned beam and y axis of the array.

* * * * *